US005257615A

United States Patent [19]

Jones

[11] Patent Number: 5,257,615

[45] Date of Patent: Nov. 2, 1993

[54] BASEBALL, SOFTBALL AND TENNIS TRAINING DEVICE

[76] Inventor: J. David Jones, 1402 Beaver Dam Rd., Columbia, S.C. 29212

[21] Appl. No.: 881,803

[22] Filed: May 12, 1992

[51] Int. Cl.[5] ..... A63B 65/00

[52] U.S. Cl. ..... 124/56; 124/49

[58] Field of Search ..... 124/56, 50, 49, 47; 273/26 D, 32 F, 162 E; 294/19.2

[56] References Cited

U.S. PATENT DOCUMENTS

| | | | |
|---|---|---|---|
| 4,063,769 | 12/1977 | Zimmer | 294/19.2 |
| 4,253,668 | 3/1981 | Ose | 294/19.2 |
| 4,270,511 | 6/1981 | Ehama | 124/56 |
| 4,345,578 | 8/1982 | Speer | 124/56 |
| 4,858,921 | 8/1989 | Eustice | 124/56 |
| 4,886,269 | 12/1989 | Marocco | 124/56 |
| 5,060,996 | 10/1991 | Garnes | 294/19.2 |
| 5,133,330 | 7/1992 | Sharp | 124/56 |

FOREIGN PATENT DOCUMENTS

| | | | |
|---|---|---|---|
| 2454820 | 12/1980 | France | 294/19.2 |

*Primary Examiner*—Randolph A. Reese
*Assistant Examiner*—Anthony Knight

[57] ABSTRACT

A training device for improving baseball, softball and tennis skills is provided by the present invention. More specifically, it is a versatile training device with a control box offering various functions to include a universal adaptor to leaf-yard blowers, fittings for extender and discharge tubes, a built-in stand and a control box design to cause a turbulence and capturing of air. The invention has various sized, curved and shaped tubing so as to throw various pitches, such as, softball loobs and coach's pitch loobs, fastballs, grounders, pop flys and believed curved balls. The invention has proven to help both the skilled and unskilled and has an optional designed automatic ball feeder, ball retriever and storage hopper.

9 Claims, 3 Drawing Sheets

BASEBALL, SOFTBALL AND TENNIS TRAINING DEVICE

The present invention relates to a training device for improving Baseball, Softball and Tennis skills. More specifically, it is a versatile training device with a control box offering various functions to include a universal adaptor to leaf - yard blowers, fittings for extender and discharge tubes, a built-in stand and a control box design to cause a turbulence and capturing of air. The invention has various sized, curved and shaped tubing so as to throw various pitches, such as, softball lobs and coach's pitch lobs, fastballs, grounders, pop flys and believed curved balls. The invention has proven to help both the skilled and unskilled and has an optional designed automatic ball feeder, ball retriever and storage hopper.

STATE OF THE ART

This story began with me as a little league baseball coach. I found that by throwing wiffle balls to young players they were able to practice technique, reflex and gain confidience in hitting and fielding. My 14-year old son came to me to discuss his eighth-grade science project. We chose to seek a way to inexpensively throw wiffle balls at a speed that would simulate actual hitting and fielding conditions. The result was that with the first model his brother's batting average increased from 0.320 to 0.547, and the first five players to receive a home-made version all made the All Stars that year. The prior art for throwing wiffle, baseball and tennis balls consists of machines that have one or two wheels spinning, or a configuration with a diaphram that builds up pressure sufficient to overcome the diaphram. The machines are very expensive and have no real similarities to the present invention. Never seen on the market, but known, is a patent by Morocco of Australia disclosing a method whereas a small table Tennis ball can be sucked up with a negative pressure or gravity fed into a tube and weakly hurled less than ten feet across the table Tennis net. Morocco's Table Tennis invention is somewhat similiar to this invention in that it throws a ball using air, but very different in purpose, function, efficiency and design. Morocco's invention was never thought, meant or anticipated to be a highly efficient Baseball, or Tennis training device that universally adapts to the different brands of, leaf blowers and throws balls in excees of 35 mph, softball lobs, grounders and believed curve balls. It has no control box, no thought to maximation of energies and velocities, positive pressures, curved tubing for softball lobs, grounders and curves or a universal adaptor for allowing the attachment of the different brands of leaf blowers allowing an easy and precise placement and fit, or an optional automatic feeder and ball retriever, resulting in a very different, efficient, high performance and versatile Softball, Baseball and Tennis training device. No similiar simple and inexpensive device with the above features is known for training Baseball, Softball and Tennis players as is the present invention.

OBJECTS OF THE INVENTION

The principal object of this invention is that it comprises and provides a training device that is powerful and flexible enough to similuate actual various conditions suitable, inexpensive, practical and challanging for training Softball, Baseball and Tennis players as related to each sport.

It also is an object of the present invention to provide a simple and inexpensive device that universally adapts to the different existing leaf blowers (yard blowers) for the power-source. It is an object of this invention to have a control box with the built-in universal adapator to adapt different models of leaf blowers easliy, and in the most efficient predetermined places. Another object is to provide a control box designed with a series of holes and obstacles in the lower tube so as to cause a turbulence of air which forces its way into the entry tube allowing less length to be used in the discharge tube by aiding and assisting in holding the ball to be thrown on a bed of air at the top of the entry tube. The control box also has predetermined heights and angles for trajectoies of the ball and the control box design allows all the above to be formed in one piece.

A further object is to have a series of tubes at a predetermined length and inner diameter size so as to aid in the performance. To overcome the needed long lengths and bulkiness, the tubes interlock and are lightweight and easily disassembled for transporation and storage. A further object is to have a predetermined curved section of tube to allow the throwing of softball lobs, grounders, and possible curve balls. The curved section of tubing for the curve balls will curve upward then downward, as well as at an angle to create the desired action of the ball. It is also an object of this invention to have available an optional automatic feeder with a built-in ball retriever and storage hooper.

SUMMARY OF THE INVENTION

These and other objects are achieved by having a single piece control box being universally adaptable to the different models of leaf blowers and a series of tubes with predetermined distances, measurements, angles, curves, turbulances turbulences, air pockets and back pressures comprised so as to, without moving parts, hurl a challanging wiffle ball, baseball, softball lob, grounders, pop flies, believed curves or tennis ball in a simple, inexpensive and more efficient and challanging way. An optional automatic feeder and built in ball retriever and ball storage hopper will enhance the use of the invention.

This invention will prove to be the first alternative for an inexpensive device that will hurl balls at a velocity and trajectory that simulates actual conditions to each sport. With no moving parts the control box design is a vital part of workability and affordablity of this invention. First, the control box has a universal adaptor that allows different models of leaf-yard blowers to be easily adapted while having them placed in a predetermined place that is most efficient to the performance. Second, the control box has a series of holes and obstacles in the lower tube so as to create a turbulence that pushes air into the entry tube to assist in holding the ball until the port is sealed off and fired. These holes and obstacles are also believed to cut down on the length of discharge tubes needed. The needed length of the tubes can also be shortened by placing an indentation in the tubes or bending the tubes. Thirdly, the control box is built to hold and support the leaf blowers and discharge tubes in the right positions and angles to determine the desired trajectory of the ball. Fourthly, the hollow stand of the control box is believed to aid in capturing back pressure to further add velocity to the ball while also serving to hold the leaf blower, extender tubes and discharge tubes in place. Fifthly, the control box has an entry for the ball and sixthly, the control box has an opening to insert the discharge tubes. A desired length and size of tube is then determined to most efficiently shoot the desired ball. When the ball starts to float on a bed of air the desired combinations and most effecient combination is intact. In the case of the wiffle ball, taking a constant of 320 CFM's of air times the weight of the ball—1.5 oz.×the Diameter of 2.85 in. gives a desired length of 4.275 ft. A tennis ball with a wt. of 2.7 oz. and a diameter of 2.45 would need a length of 5.71 ft. Inherently, this invention will need long tubes for maximum performance. To overcome this the tubes are made in short lengths that lock to each other for ease of transport and storage. To further reduce the long lengths of the tubes one can make the I D of the tube increase sharply for a short distance or simply bend the tube. By having curved sections of tubes, lobs and grounders can be thrown and by having and rotating upward and then downward an angled curved section, believed curve balls will be thrown. Lastly, an optional automatic feeder and built-in ball retriever and ball storage hopper will be an enhancement to this invention. The method and manufacture of this device will result in a very simple, inexpensive and efficient device that universally adapts to the different leaf blowers on the market and hurl a ball at a very efficient and high rate of speed in the form of fast balls, softball lobs, grounders and believed curves. The foregoing and other objects and features will become more apparent as they are described in more detail in the preferred embodiments and illustrations in the accompanying drawings.

BRIEF DISCRIPTION OF DRAWING

DESCRIPTION OF THE PERFERED EMBODIMENT

Figure 1:
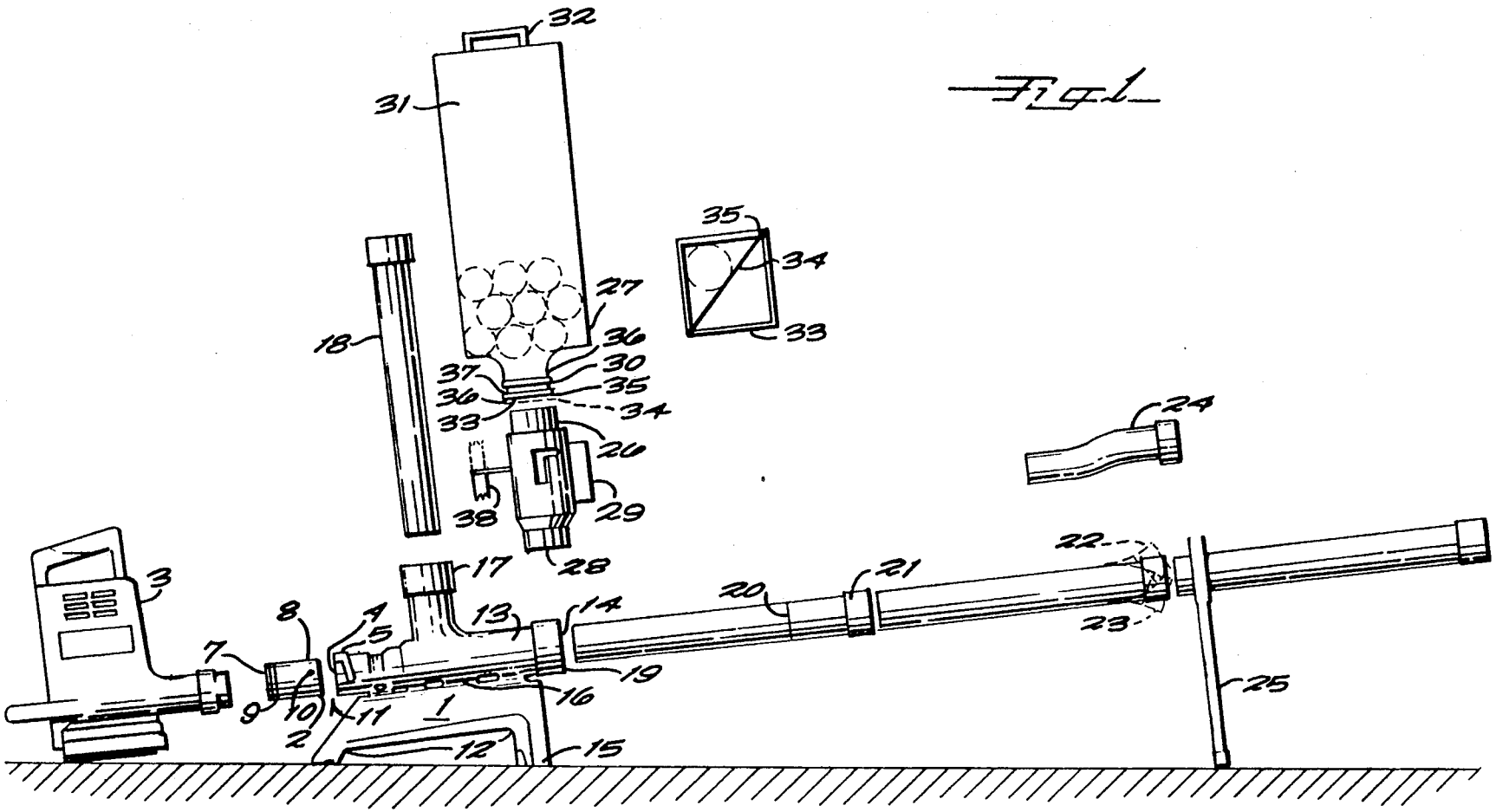
FIG. 1 is a side elevation of a Softball, Baseball and Tennis training device in accordance with the present invention.
Figure 2:
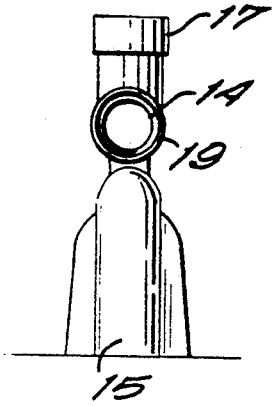
FIG. 2 is a front view of the control box.
Figure 3:
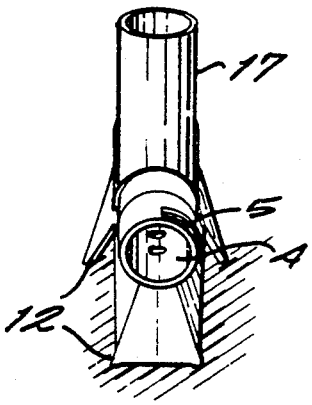
FIG. 3 is a rear top view of the device.
Figure 4:
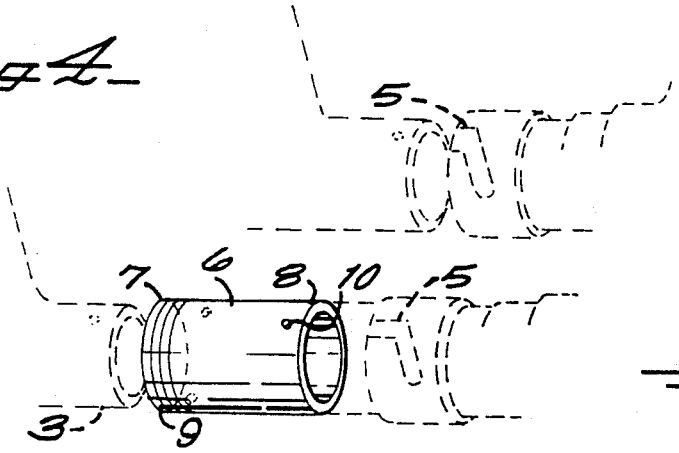
FIG. 4 is an enlarged, fragmentary section of the universal adaptor.
Figure 5:
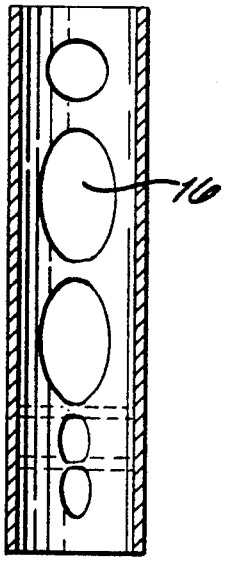
FIG. 5 is an enlarged, fragmentary section of the inside lower tube of the control box.
Figure 6:
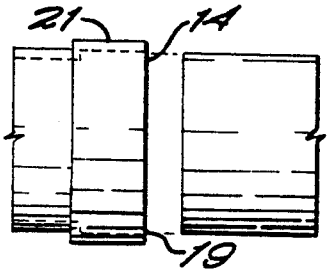
FIG. 6 is an enlarged fragemented view of the connecting sections of the tubes.
Figure 8:
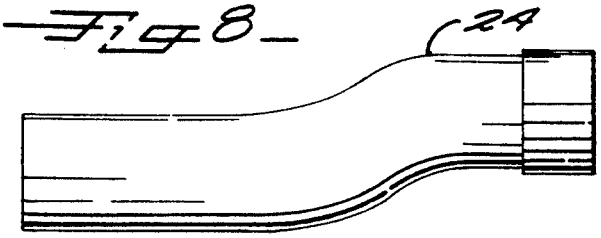
FIG. 8 is a curve ball curved section rotating at an angle in an upward and downward fashion.
Figure 7:
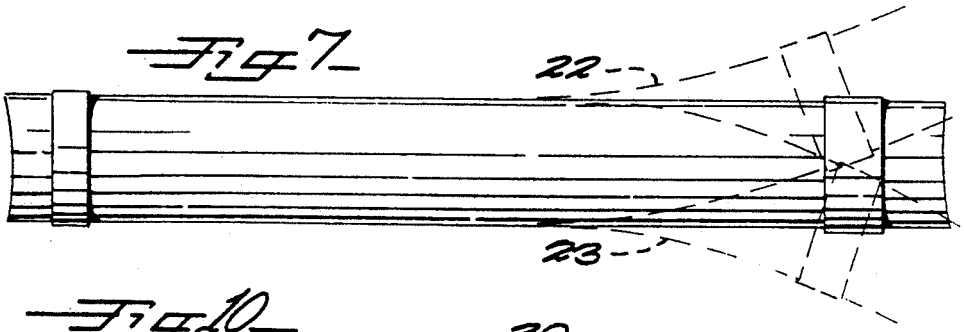
FIG. 7 is a curved portion of tube fitting within the discharge tubes to allow grounders, balls and believed curve balls.
Figure 10:
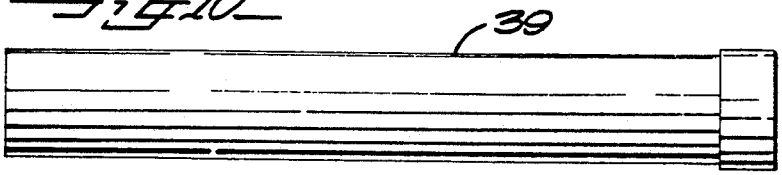
FIG. 10 is a smaller inner and outer diamenter tube for throwing tennis balls.
Figure 9:
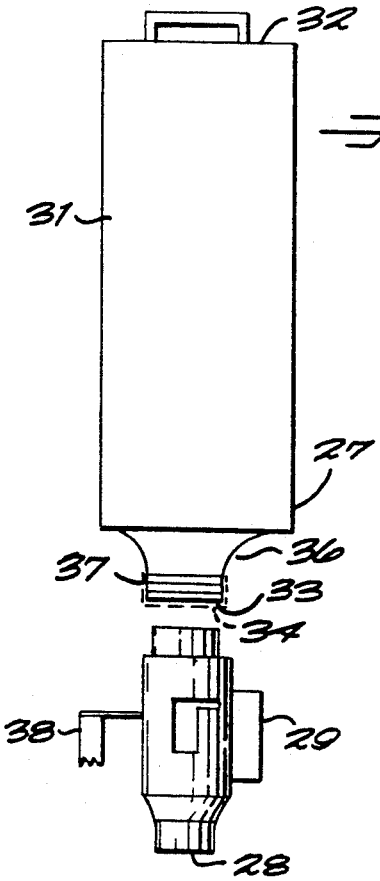
FIG. 9 is the optional automatic ball feeder with a built in ball retriever and ball storage hopper.
Figure 11:
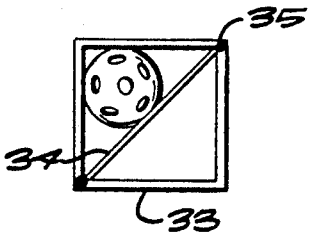
FIG. 11 is an end view of the hopper illustrated in FIG. 9.

As shown in the drawing, the perferred Softball, Baseball and Tennis trainer in accordance with the present invention includes a control box 1 of a particular shape, angles and design made from a molded durable plastic, epoxy, resin or metal. The control box has built-in features with the first being a universal adaptor 2 for adapting to the different versions of leaf blowers 3 with a predetermined placement and fit.

The particular design size and shape within the control box is such that it will adapt to the more popular brand of leaf blower as well as work and serve as part of the universal adaptor. The inner dimension 4 of the control box opening is such that the blower will snugly fit into the control box. The placement and design is such that the distance from the ball entry opening is not to be too close or far away from the opening. If the blower were allowed to be placed too close to the ball entry opening, it would result in a loss of pressure in the entry tube or port. If the connection or connections were loose and not properly adapting to the blower, it would also greatly effect the performance. To further insure a proper fit and seal, the opening also has locking fingers 5 so as to tighten and hold the blower in place. These locking fingers are designed in such a way as to allow the nipples of the blower or the adapter to first fit into the opening by twisting the adapter or blower relative to the control box. Thus, the adapter or the adapter and blower are pulled to each other, and the connection is prevented from coming loose. End 9 of the universal adapter allows other various models of leaf blowers to also universally adapt to the control box. End 9 of the universal adaptor measurements are critical in length, inner dimension and outer dimension and wall thickness 7. The length of end 9 is set relative to the distance to the control box, the blower and the distance of the blower from the ball entry point. The outer diameter 8 of the adapter is made such that it will snugly fit into the inner diameter of the control box. This and these connections can be made in many shapes and forms or could even be made with or without the locking nipples or fingers or devices depending on how close one can control their manufacturing tolerances. The outer diameter of the adapter which adapts to the blower is such that various models of leaf - yard blowers will snugly fit over the outer diameter of the adapter. To further adapt to different models the wall thickness of the adapter is such as to from an inner diameter that will allow the insertion of the outer diameter of the blower to form a snug fit. To further insure a snug fit the inner and outer diameters have rings and nipples 10 to the inside and outside to assist in holding the blowers in position. The opening in the control box is designed to be a certain distance and height to the ground 11 to start the beginning of the needed trajectories while holding and supporting the blowers and allowing efficient air flow. Along with its many functions the control box also serves as a stand 12. Its length and width are such that it supports the control box tube at an angle allowing certian trajectories of the balls. The stand also gives support to the discharge tubes. The control box tube 13 is of an inner dimension slightly larger than the ball having a universal adaptor and certain size holes 14 to receive extender tubes and discharge tubes while serving as a base 15 with predetermined angles and designs so as to allow one piece manufacturing. The holes in the bottom of the control box 16 allow two major functions. First, these holes and, obstacles are believed to further help and assist in forming a turbulence and capturing of air that will create a greater back or positive pressure to help support the ball in the entry tube and also gains a believed greater distance while using the same or shorter discharge tubes. Secondly, the holes between the control box tube and the stand along with the control box design allow the stand, tube and adaptor and complete control box to be formed and molded from plastic, epoxies or metals in a one step inexpensive process versus assembling or putting together the different components. The entry hole 17 of the control box is slightly larger than the ball and designed such that an extender tube 18 will snugly fit into the control box. The ball will hover at the top of the control box but the extender tube keeps a person from repeatedly bending down to the control box. The operator will place the ball on the bed of air created at the top entry tube or the extender tube. A ball can be thrown without the ball hovering at the entry port, the hovering of the ball is not a claim of this patent. It is a claim of this patent that the design of the control box along with the holes in the bottom of the control box tube assist in the hovering of the ball and capturing back pressures. This invention with its design, predetermined placement of the blowers, and size and lengths will hover the ball at the extender tube or control box opening for the ease of the operator. This feature allows time for the operator and catcher or hitter to prepare and set and adjust his or her timing to the motions, and to have time to better seal the port. When the operator seals off the entry port or extender tube by means of a device or hand, the ball will then drop into the control box and discharge in a very efficient manner. The discharge opening of the control box 19 is slightly larger than the ball with an inner diameter that will allow the discharge tube or tubes to snugly fit into the control box. Their inner diameter 20 is slightly larger than the ball. They are usually long in nature and the trajectory angle is preset by the angle from the control box. The ends of the tubes 21 are slightly larger so as to snugly interlock with each other to allow easier transportation and storage. The tubes can be shortened in length by slightly bending the tube or for a very short distance increasing the outer diamenter of the tube both adding to the back pressure without having to increase the length. The size, shape and lengths of the discharge tubes will vary depending on the size and weight of the ball being thrown. The discharge tubes should be constructed such as to create sufficient back pressures to aid the control box in creating enough positive air in the ball entry port or extender tube to support the ball. As a rule of thumb, I have found by using a constant of 320 CFM of air about which leaf blowers generate, then taking the weight of the ball times the size of the ball one can have an idea of how long the tube might need to be. In the case of the wiffle ball 1.5 oz.×2.85 inches=4.275 ft. of discharge tube will be close to the most efficient and desired length. A somewhat shorter length will work and a longer length may slightly increase performance but this may be termed as the comprised length. In the case of a tennis ball tube 39 having a wt. of 2.7 oz.×the size of 2.45=6.615 ft. of desired discharge tube. The needed lengths of the discharge tubes can be shortened by slightly bending the tube or increasing the ID for a very short distance. In the case of a baseball, the needed long length was shortened by having a bend at the beginning of the discharge tube. To make the present invention even more flexible, a curved section of discharge tube 22 allows the invention to throw lobs simulating hitting conditions of softball soft-pitch and the youngster's coaches-pitch. When turned straight down to approximately 180 degrees 23 the invention will throw short-hop grounders simulating actual fielding and reflex conditions. A curve ball curved section is made such that while rotating and gradually turning at an upward and then downward motion it will sufficiently spin the ball in the right motions so as to hurl believed curve balls 24. It is also found that by varying the shape and design of the balls, curves and so-called junk pitches can be thrown. The stand 25 is included to assist in holding the discharge tubes while allowing adjustments to different trajectories of the ball by sliding the stand up and down the tubes. Not necessary to the invention, but an enhancement thereof, is an optional automatic ball feeder 26 and a built-in ball storage hopper and ball retriever 27. The automatic ball feed has an OD 28 so as to be received by the control box and a battery, electrical, solar or mechanical device 29 so as to rotate a cam or scoop in such a fashion so as to let one ball in the control box on a timed basis. The same cam protrudes to the outside of the feeder where a flag is positioned 38 so as to warn the hitter when the ball is about to be hurled. The ball storage hopper and ball retriever has an OD 30 that will snugly fit into the feeder. The hopper or retriever is of a sealed nature 31 so when the snug connection is formed the floation of the balls will cease and the balls will then drop into the control box and discharged as they are released. A handle 32 is built into the retriever to hold the retriever while gathering the balls. The retriever has an opening with a size and shape 33 such that when a flexible or stiff rod 34 is diagonally stretched or put across the opening in predetermined slots 35 a ball will be picked up by pressing the ball to either side of the opening and stored in the hopper. The flexible or stiff rod across the diagonal opening is stretched and attached to a holder slot 36 or hinged 37 so that they can be can be easily taken out of the way so that when placed in the feeder the rod or flex does not obstruct the falling of the balls and the hinges and slots do not interfere with the adaptation of the feeder and the retriever.

The foregoing discription of the perferred embodiment of the invention has been presented for the purposes of illustration and description. It is not intended to be exhaustive or to limit the invention to the percise form disclosed. Many modifications and variations are possible in light of the above teaching. It is intended that the scope of the invention be limited not by this detailed description, but rather by the claims appended hereto.

What is claimed is:

1. A ball propelling apparatus comprising:

a control box including a hollow tubular portion having first and second open ends that defines a linear air discharge axis, apertures being formed in said hollow tubular portion along said air discharge axis;

an entry tube having an entry hole at one end, and being attached to said control box at the other end, said entry tube having a cylindrical tube wall that is free of apertures, and said entry hole is positioned above said air discharge axis; and a source for providing a high volume of flowing air attached to said first open end of said control fox, air from said source of flowing air being forced along said air discharge axis and out said second open end, and through said apertures which increases the back pressure of the flowing air, said air also being forced through said entry tube to said entry hole;

wherein when a ball is positioned at said entry hole, air flows around said ball, and when said entry hole is closed said ball drops onto said air discharge axis and is propelled from said control fox through said second open end by said flowing air.

2. A ball propelling apparatus as recited in claim 1 further comprising an adapter for attaching the source of flowing air to the control box.

3. A ball propelling apparatus as recited in claim 1 wherein the source of flowing air is a leaf blower.

4. A ball propelling apparatus as recited in claim 1 further comprising a hopper sealed at one end, and attached to said entry hole at the other end.

5. A ball propelling apparatus as recited in claim 4 wherein said hopper is detachable from said control box, and includes a handle said one end and an opening said the other end having a ball restriction which allows the hopper to be used as a ball retriever when not attached to said control box.

6. A ball propelling apparatus as recited in claim 1 wherein a discharge tube is attached to said second open end of said control box.

7. A ball propelling apparatus as recited in claim 1 wherein a flexible discharge tube is attached to said control box.

8. A ball propelling apparatus as recited in claim 1 wherein said control box has integrally incorporated therewith a stand for supporting the control box and thus setting the trajectory of a ball propelled from said apparatus.

9. A ball propelling apparatus as recited in claim 1 wherein said discharge tube is curved.

* * * * *